US008091715B2

(12) United States Patent
Roth

(10) Patent No.: US 8,091,715 B2
(45) Date of Patent: Jan. 10, 2012

(54) ADJUSTABLE PALLET DISPLAY UNIT

(75) Inventor: Michael C. Roth, Highland, NJ (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 895 days.

(21) Appl. No.: 11/414,075

(22) Filed: Apr. 28, 2006

(65) Prior Publication Data

US 2007/0000857 A1 Jan. 4, 2007

Related U.S. Application Data

(60) Provisional application No. 60/676,078, filed on Apr. 28, 2005.

(51) Int. Cl.
*A47B 47/06* (2006.01)
*A47B 57/34* (2006.01)

(52) U.S. Cl. ..... 211/187; 211/191

(58) Field of Classification Search ..... 211/195, 211/186, 149, 72, 73, 134, 70.1, 191, 187; 108/115, 53.5
See application file for complete search history.

(56) References Cited

U.S. PATENT DOCUMENTS 1,519,207 A * 12/1924 Kay ..... 108/101
2,049,231 A * 7/1936 Storch ..... 108/165
3,322,382 A * 5/1967 Rohrbach ..... 248/159
4,488,652 A * 12/1984 Hinton et al. ..... 211/183
4,813,553 A * 3/1989 Franklin et al. ..... 211/133.1
4,879,800 A * 11/1989 Rumman ..... 29/450
4,996,929 A * 3/1991 Saal ..... 108/107
5,048,701 A * 9/1991 Simpson ..... 211/189
5,632,390 A * 5/1997 Podergois ..... 211/195
5,785,183 A * 7/1998 Rejete ..... 211/1.51
5,896,995 A * 4/1999 Murray et al. ..... 206/736
6,135,033 A * 10/2000 Deferrari ..... 108/165
6,267,255 B1 * 7/2001 Brush ..... 211/59.4
6,382,433 B1 * 5/2002 Podergois ..... 211/195
6,474,483 B1 * 11/2002 Montoya et al. ..... 211/149
D489,198 S * 5/2004 Mason et al. ..... D6/461
6,920,831 B2 * 7/2005 Lin ..... 108/107
7,140,307 B1 * 11/2006 Wolbert ..... 108/153.1
7,252,200 B1 * 8/2007 Hester ..... 211/72
7,258,231 B1 * 8/2007 Wertz et al. ..... 206/386
2001/0002652 A1 * 6/2001 Polacco ..... 206/386

* cited by examiner

*Primary Examiner* — Michael Safavi
(74) *Attorney, Agent, or Firm* — Kilpatrick Townsend & Stockton LLP

(57) ABSTRACT

There is provided an adjustable display pallet and a method for manufacturing display pallets. In certain embodiments, display pallets have a pallet base, corner columns, and span members that are adapted to hold individual products or trays of product. Corner columns are adhered to the pallet base in the desired locations. Span members are then inserted through insertion portions on the corner columns. The insertion portions are shaped to receive and secure span member ends. Optional end caps, backer panels and print panels may be provided on the pallet displays to enhance visual aspects of the display, as well as provide additional marketing space.

24 Claims, 9 Drawing Sheets

ADJUSTABLE PALLET DISPLAY UNIT

This application claims the benefit of U.S. Provisional Application Ser. No. 60/676,078, filed Apr. 28, 2005, titled "Adjustable Pallet Display," the entire contents of which are hereby incorporated by reference.

FIELD OF THE INVENTION

Certain embodiments of the present invention relate to adjustable pallet displays that can be built easily and quickly and using parts typically kept in inventory, in order to provide display units. The pallet display units can be manufactured efficiently and are intended to be used for point of sale display of consumer packaged goods.

BACKGROUND

In many instances, products are displayed in store aisles (or at the ends of store aisle) by display units. The display units are typically provided according to the product manufacturer's dimensions, e.g., a 3-sided unit with four tiers per side, etc. Additionally, many retail locations have specific dimensions that display units must meet, e.g., length cannot exceed 54 inches and unit can only be so many feet high, etc.

One challenge that is often encountered when designing and building customized display units for product manufacturers is that different dimensions, requirements, and materials are involved, some requiring special ordering, which can make it time consuming and expensive to build custom units that meet individual specifications. For example, some display units will be used to display heavy items, such as bottles of suntan lotion or bleach, which require relatively sturdy shelves, whereas other units may be used to display paper products or t-shirts, which can use much lighter shelves. In addition, some display units will need to be larger than others, due to the intended placement in the retail location or the size or volume of the items to be displayed.

Nonetheless, it is still desirable for the product manufacturer to be able to specify how a particular product is to be displayed. Marketing studies are performed to determine the most effective way to display products and where their display (e.g., at what location in the retail store) is most effective for increased sales, and product manufacturers need to be able to take advantage of that information and continue to design their displays accordingly.

Because of these desired customized design requirements, it would be useful for packaging companies to be able to manufacture display pallets out of materials that are already commonly maintained in stock to lower costs and reduce special ordering time.

Another challenge faced in designing effective display units is getting the product appropriately loaded. Typically, a product manufacturer ships product to a display unit manufacturer, who designs a display unit from the ground-up, including display trays or other methods of displaying the product on a shelf or an individual display unit. It is, however, desirable to provide an adjustable pallet that will allow the display unit manufacturer to build an adjustable display pallet to fit trays that have already been manufactured and that are not being displayed on store shelves due to inventory and space constraints. This way, the pre-existing tray can be loaded with product, loaded on an adjustable pallet, and shipped, alleviating the need to rebuild an entirely new tray and display unit design. It is also desirable to provide the pallet in a form that will allow portions of the product to be removed from the pallet once inventory is low and be displayed on store shelves, or vice versa.

Accordingly, it is desirable to provide a way to continue to provide a customized design for a display unit, but maintain cost effectiveness and high efficiency. It is also desirable to provide the display unit on a pallet that can be shipped for immediate display. It is further desirable to provide an adjustable design for a pallet, allowing the display pallet to be built quickly from parts commonly kept in inventory.

SUMMARY

There is provided an adjustable display pallet and a method for manufacturing display pallets. In certain embodiments, display pallets have a pallet base, corner columns, and span members that are adapted to hold individual products or trays of product. Corner columns are adhered to the pallet base in the desired locations. Span members are then inserted through insertion portions on the corner columns. The insertion portions are shaped to receive and secure span member ends. Optional end caps, backer panels and print panels may be provided on the pallet displays to enhance visual aspects of the display, as well as provide additional marketing space.

In one aspect of the invention, there is provided a display pallet, comprising (a) at least two corner columns, each corner column comprising a foldable member with a hinge that separates two panels, at least one of the panels having one or more insertion portions, and (b) one or more span members adapted to be received in the one or more insertion portions.

In another aspect of the invention, there is provided a method of manufacturing a display pallet, comprising (a) providing a pallet base; (b) providing two or more corner columns, each corner column comprising a foldable member with a hinge that separates two panels, at least one of the panels having one or more insertion portions, (c) providing one or more span members; (d) assembling the corner column by separating the panels and folding them at an angle to one another; (e) securing the panels to the pallet base; and (f) placing one or more span members into the insertion portions of the corner columns. Other embodiments and specific features are described and shown in more detail below.

DETAILED DESCRIPTION

Figure 1:
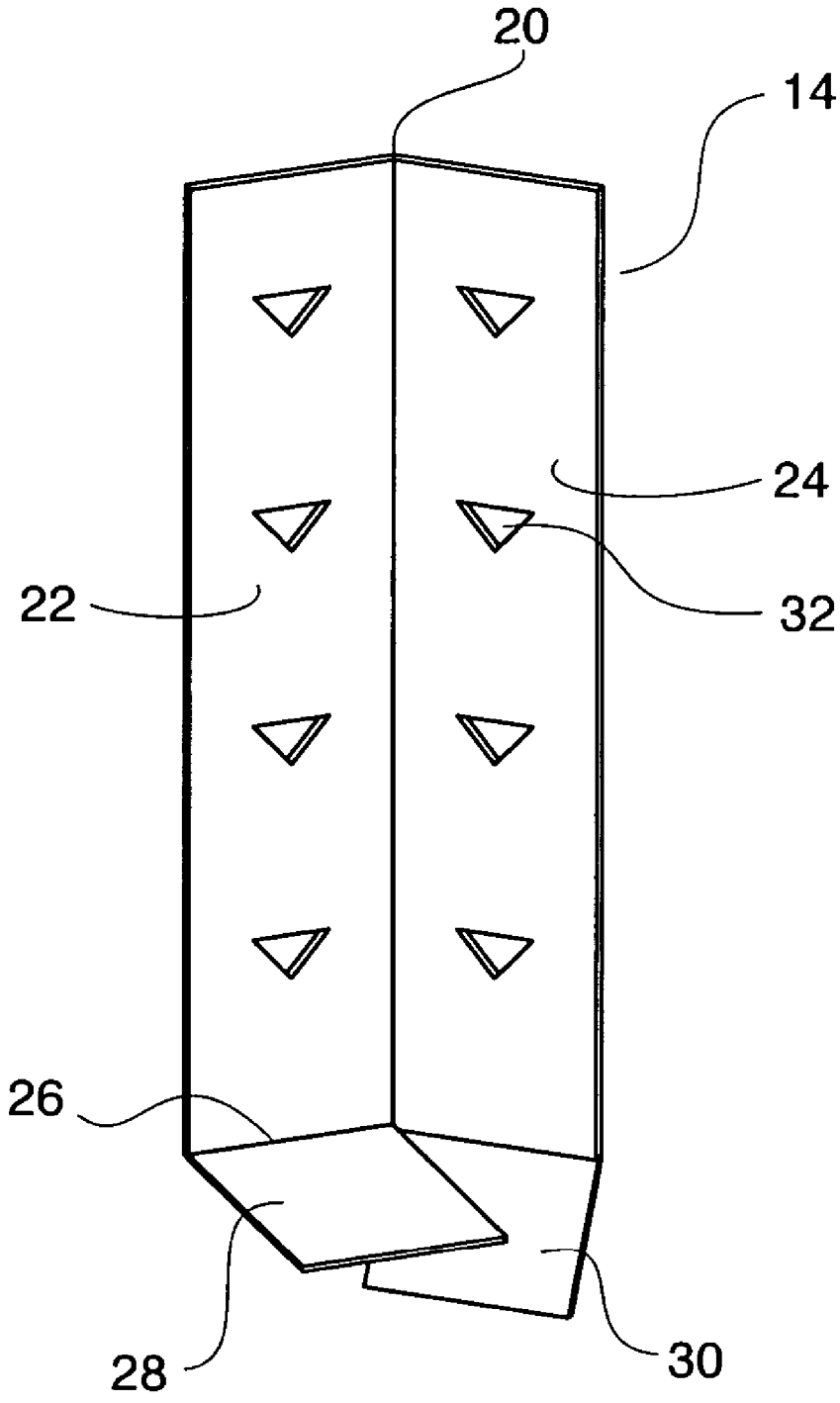
FIG. 1 shows a front perspective view of a corner column according to certain embodiments of the present invention.
Figure 2:
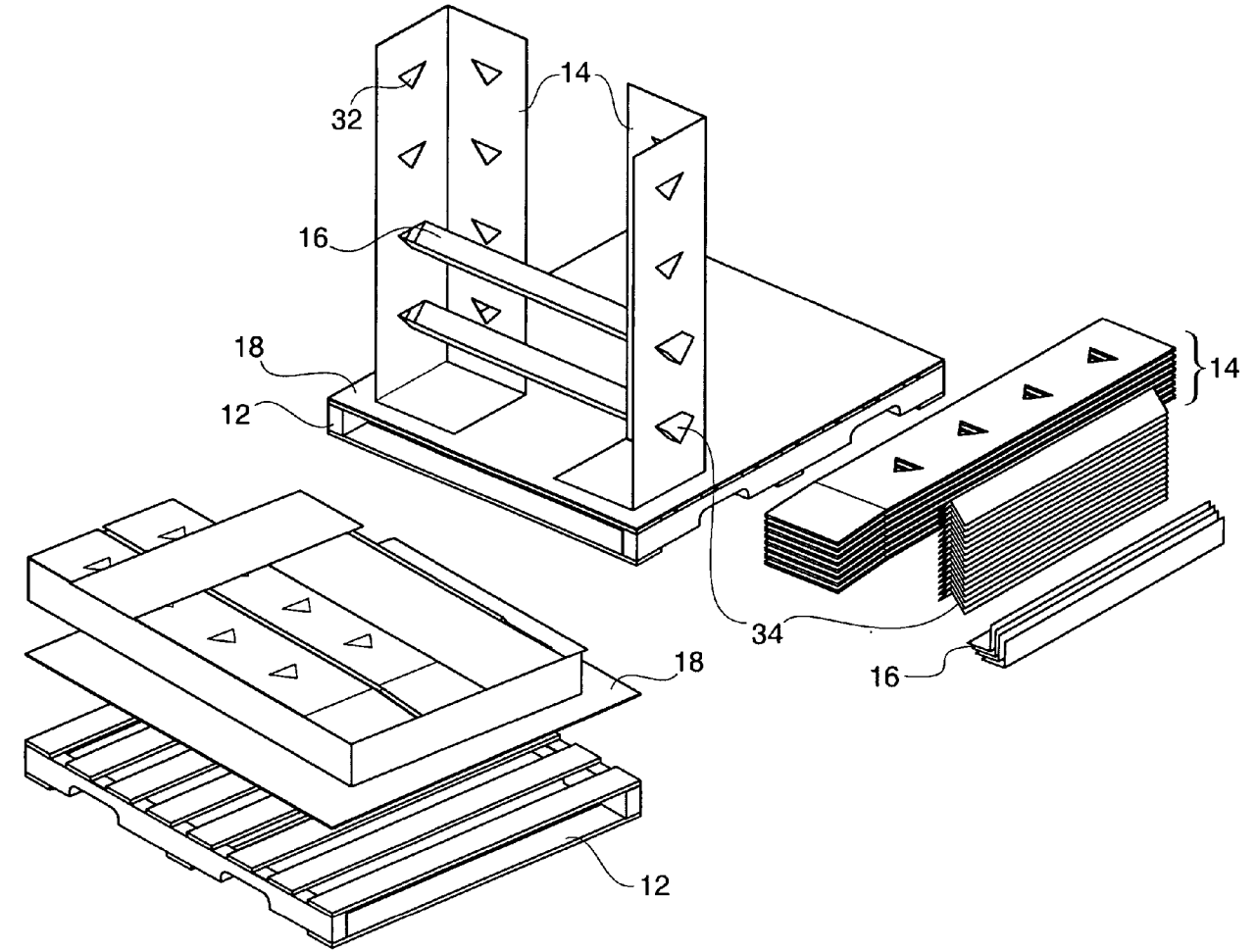
FIG. 2 shows a front perspective view of a pallet display that is partially manufactured.

FIGS. 3-6 show a display pallet 10 according to certain embodiments of the invention. FIG. 2 shows a display pallet in a partially assembled state, having a pallet base 12, corner columns 14, and span members 16. FIG. 1 shows a specific embodiment of a corner column 14. Referring back to FIG. 2, pallet base 12 may be any typical pallet base that is used to ship items and is typically manufactured out of plywood. An optional pallet locator pad 18 may be used to cover pallet base 12 to provide a smooth base for the display unit components.

One or more corner columns 14 are placed on top of pallet base 12 and optional pallet locator pad 18. As shown in FIGS. 1 and 2, corner columns 14 are typically provided as a foldable sheet, with a hinge 20 separating two panels 22, 24 (shown as the upper panels on FIG. 1) and another hinge 26 defining base panels 28, 30 (shown as adapted to cross or overlap over one another). As shown in FIG. 2, corner columns 14 may be provided as flat blanks for easy storage. The blanks may be provided with lines of weakness to form hinges 20 and 26. Base panels 28, 30 may be separable from one another via a line of perforation. This allows corner columns to lay flat or to be folded along hinge 20, if desired, for easy storage and erected upon demand.

The panels 22, 24 of corner columns 14 are provided with a series of insertion portions 32 that are adapted to receive span members 16. Insertion portions 32 are shaped to receive span member ends 34, and may be triangular, square, trapezoidal, circular, semi-circular, or any other appropriate shape. The goal is for insertion portions 32 to provide a receiving and resting area that will secure span members 16 in place during use.

During assembly, base panels 28 and 30 are separated from one another and overlapped over one another, adhered, or otherwise secured to one another (and also preferably secured to pallet base 12 and locator pad 18) to provide a square-shaped corner, such that panels 22, 24 are separated the desired distance. This process is shown in FIG. 1. One way this can be done is by stapling the base panels to the pallet base 12 in the desired configuration. The resulting corner column 14 is shown assembled in FIG. 2.

Typically, at least two corner columns 14 are provided, but any number of columns may be used to build display pallet 10. Corner columns 14 are typically manufactured out of corrugated paperboard, which is sturdy but inexpensive to manufacture, although they may be made out of any available material, such as plastic, aluminum, wood, and so forth. Additionally, corner columns 14 may be placed at varying angles from one another to add visual interest to the resulting display unit 10.

Once corner columns 14 are in place, span members 16 are placed across the distance between corner columns 14. Span members 34 are used to provide the support for the items to be displayed (which are typically displayed in individual boxes or trays). In a preferred embodiment, span members 16 have ends 34 that are adapted to cooperate with insertion portions 32 on corner columns 14. It is possible, for insertion portions 32 to cooperate with span members 16 (or for span members 16 to cooperate with corner columns) in any number of other ways, such as via a series of elongated slots in corner column 14 within which span members 16 may rest, via glue, staples, or other securing means, and so forth. In use, span members 16 lock the components of pallet display 10 together by locking the corner columns 14 together.

Span members are adjustable, meaning that they may be removed and replaced in different insertion portions as desired. They may also be provided in adjustable lengths if desired. For instance, different sizes of insertion members may be provided (although in some embodiments, span members are easily cut) or each span member itself may be adjustable.

In a particularly preferred embodiment, span members 16 are stacked laminated fiberboard, but it should be understood that they may be made from any appropriate material that provides the desired support functions, such as corrugated material, extruded aluminum, plastic, wood, and so forth.

Also in the preferred embodiment, span members 16 may actually be the corner posts that are used to support the sides and bottom areas of material that is shipped on large pallets. Corner posts are typically provided in a right angle-type configuration, as shown in FIG. 2, or any other configuration that provides two sides that are connected via an angle or hinge. It should be understood, however, that span members 16 may be T-shaped, V-shaped, U-shaped, square-shaped, or any other appropriate configuration that allows span members 16 to provide the desired support functions.

Figure 3:
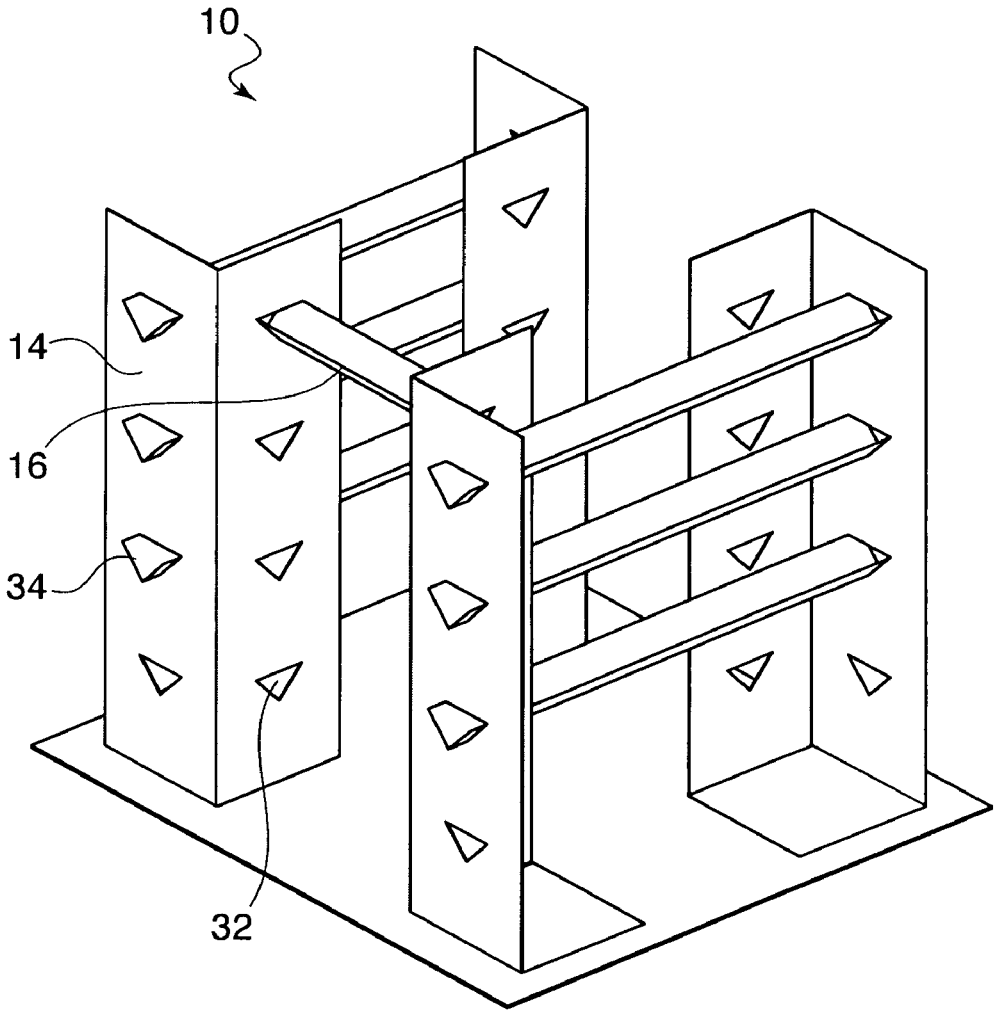
FIG. 3 shows a perspective view of a pallet display that has been assembled, prior to being loaded with product trays.

Span members 16 may vary in length and are preferably light enough that they may be trimmed easily if a shorter span member 16 is needed. Span members 16 may also be reinforced with tape or another type of support if the span member will be required to span a larger than usual distance and/or if it will be used to hold heavy items. FIGS. 2 and 3 show a display pallet 10 that has been assembled.

If desired, the span member ends 34 that protrude from corner column 14 may be trimmed. Additionally or alternatively, end caps may be used.

Figure 4:
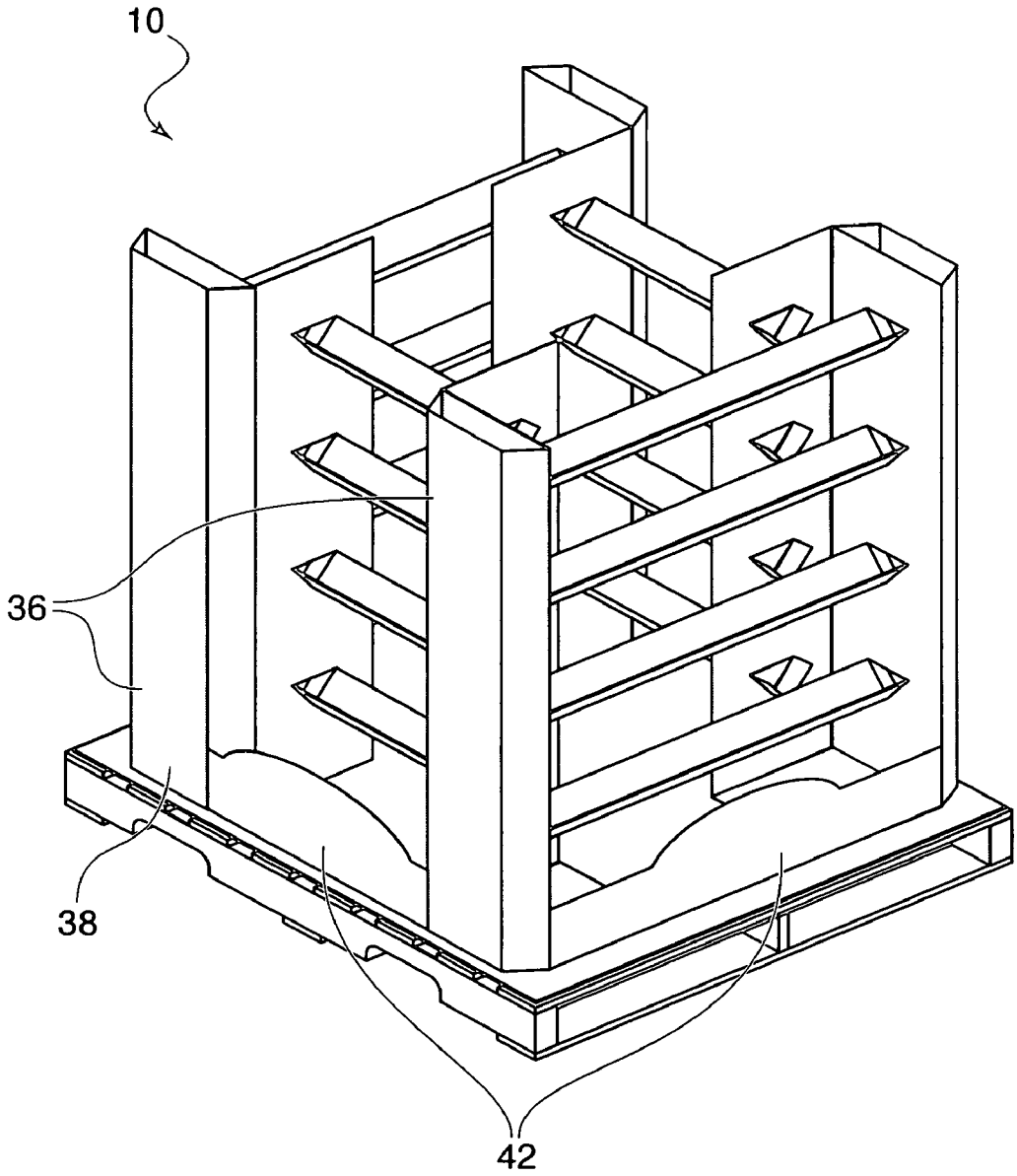
FIG. 4 shows a side perspective view of a pallet display having end caps.
Figure 5:
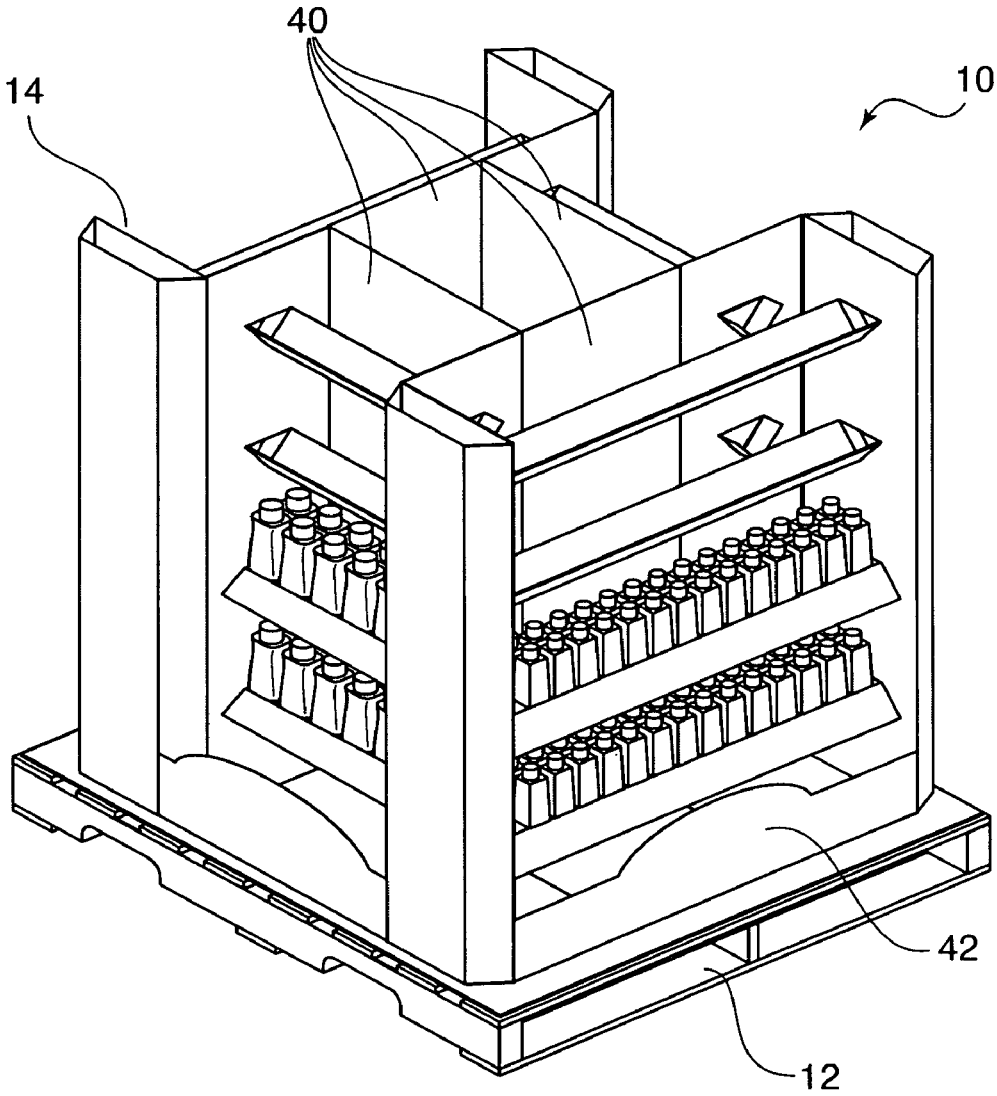
FIG. 5 shows a side perspective view of a pallet display having end caps and backer panels and being partially loaded with product trays.
Figure 6:
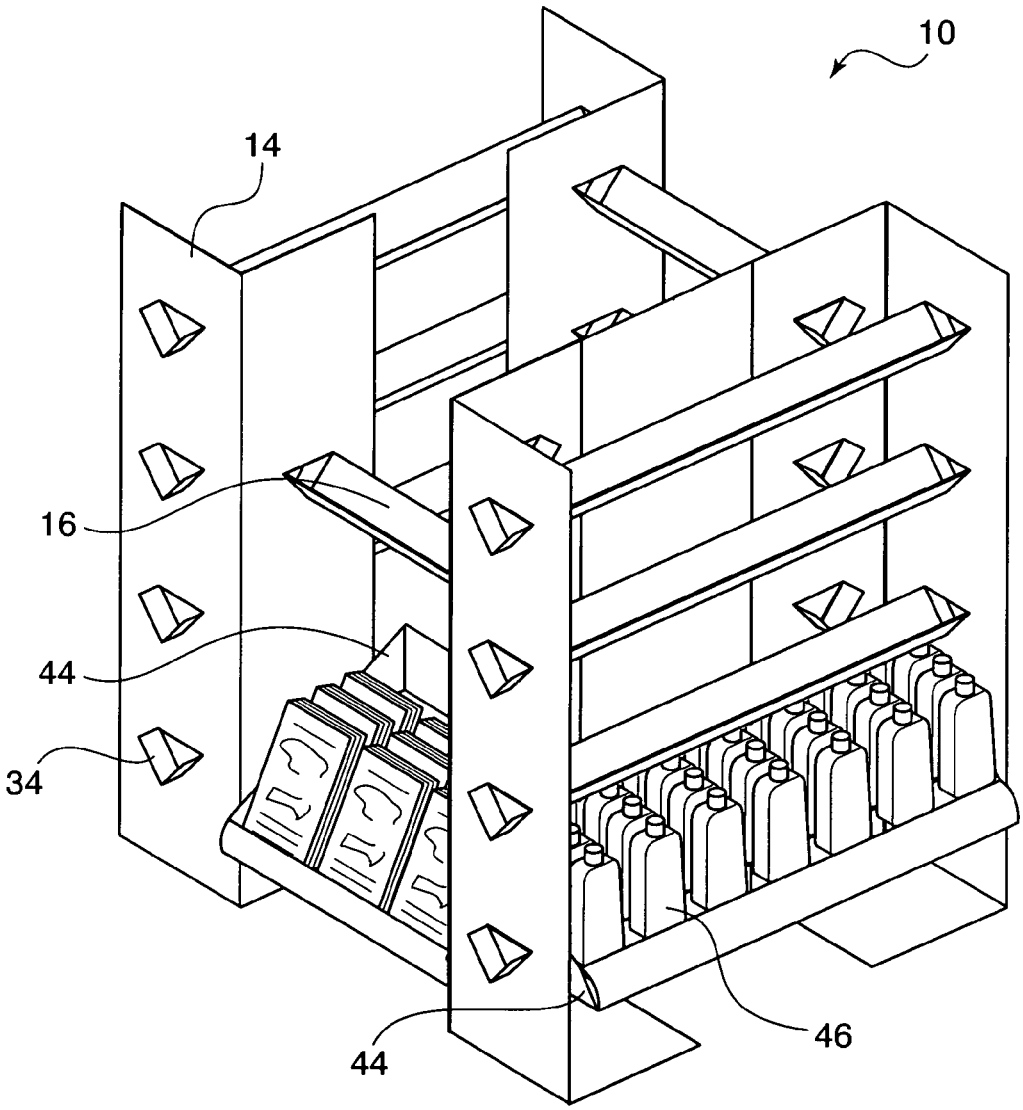
FIG. 6 shows a front perspective view of a pallet display during loading.

FIGS. 4-6 show an alternate embodiment of display pallet 10 having end caps 36. End caps 36 are provided at the span member/corner column junction 38 and cover the span member end 34 and can be used for marketing print or other materials. End caps may be square, as shown in FIG. 4-6, or they may be rounded, tear-drop shaped, triangular, wavy, or any other desired shape.

FIG. 5 shows a further embodiment of display pallet 10 having optional backer panels 40. Backer panels 40 may be attached to corner columns 14 to provide a visual back to the display and to hide the framing of the unit 10 as the product sells down. The embodiments shown in FIGS. 4-5 also feature print panels 42 that may be placed anywhere on display pallet 10 for advertising, marketing, or instructional purposes. FIG. 4 shows a four-sided unit 10 and FIG. 5 shows a three or four-sided unit 10. It should be understood that single-sided, double-sided, and many multiple-sided units 10 may be provided. For example, as shown in the close-up of FIG. 7, the multi-sided may have both corner column panels 22, 24 having one or more insertion portions, wherein a first set of insertion portions on one panel receives one or more span members, and wherein a second set of insertion portions on a second panel receives one or more span members.

FIG. 6 shows an assembled display pallet 10 being loaded with trays 44 holding product 46. Trays 44 may be designed to fit the span member 16 length, but more commonly, the display pallet 10 is built to fit the tray size that the product manufacturer plans to use. FIG. 6 also shows that a single display pallet 10 may be used to sell a number of different products on the same pallet 10. If desired, the lengths between each corner column 14 may vary on each side.

Figure 7A:
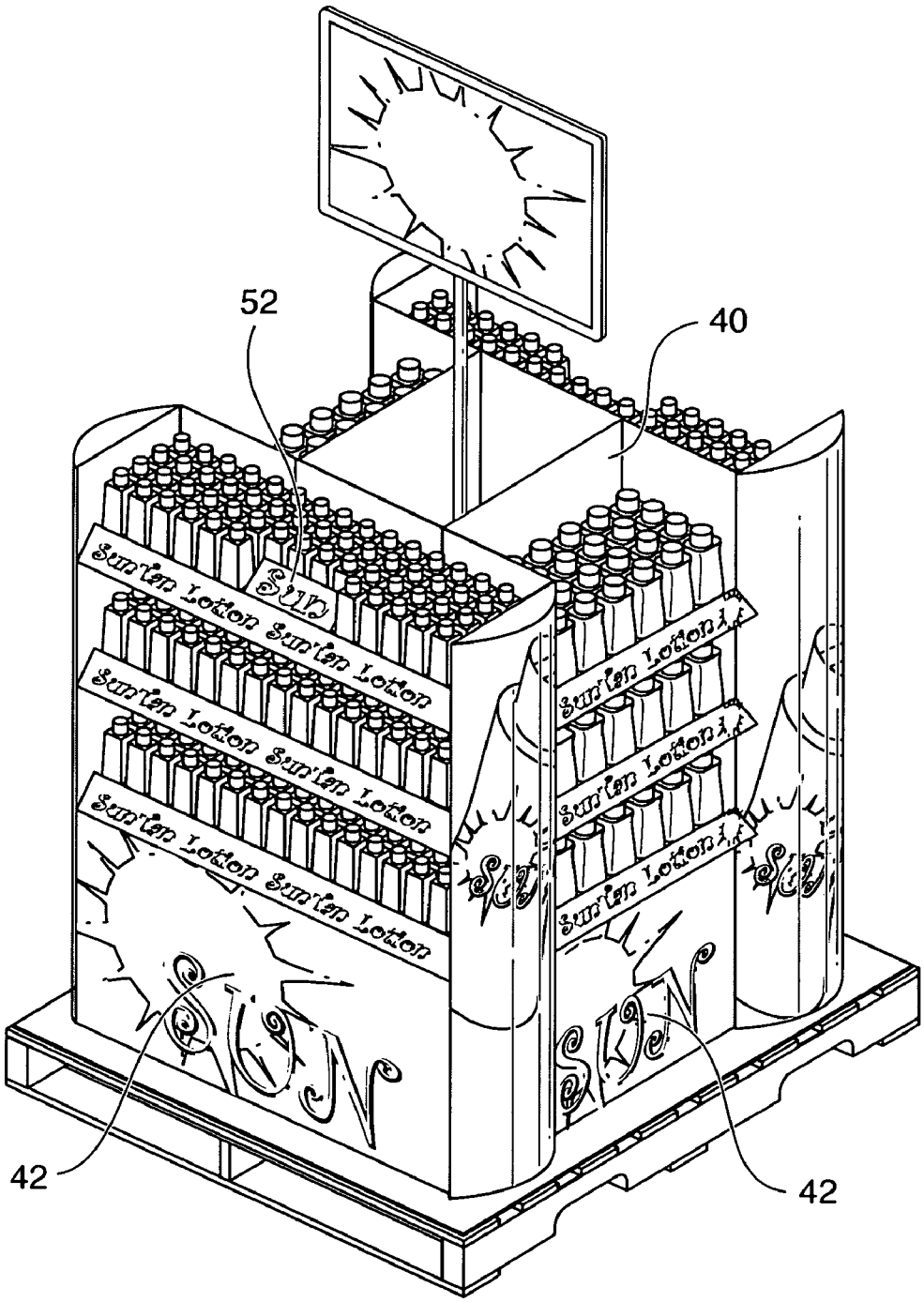
FIGS. 7A-C show side, top, and side perspective views (respectively) of a loaded pallet display.
Figure 7C:
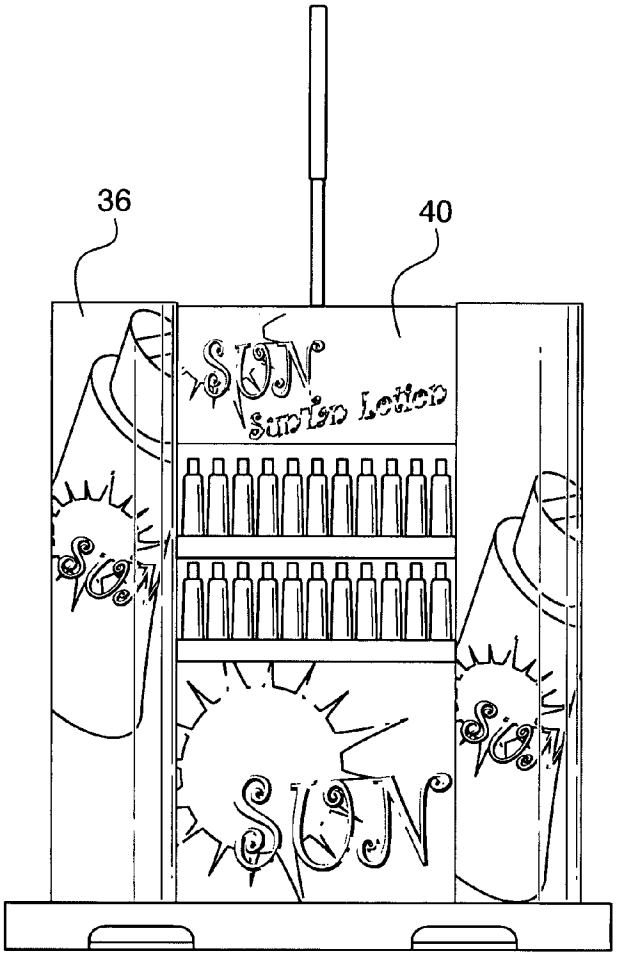
Figure 7B:
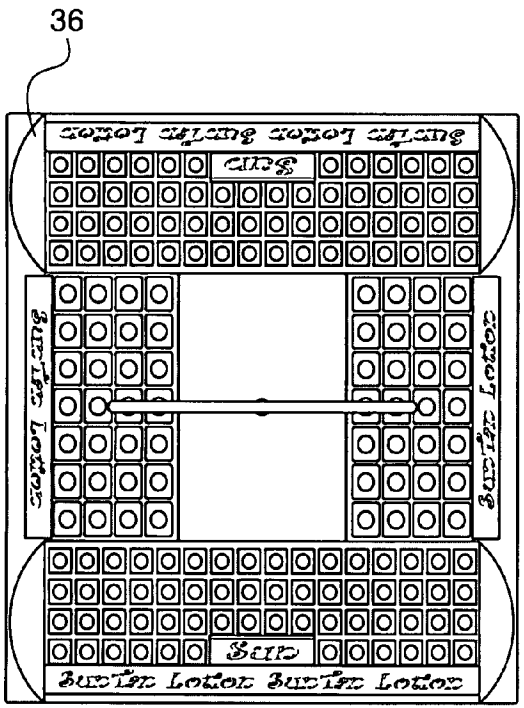

FIGS. 7A-C show a four-sided display pallet 10 having curved end caps 36, optional backer panels 40, print panels 42, and being loaded with trays of product. In this embodiment, print panels 42 cover the base portion of pallet display 10 (typically because product placed this low is not on eye-level and difficult for consumers to see and reach, but eye-catching graphics placed this low can be seen from across the store). Alternatively, print panels 42 may span the middle portion or the top portion of display pallet 10, depending upon where the pallet 10 in intended to be used. It is also possible to provide trays 44 with additional marketing opportunity areas 52 as shown in FIG. 7A.

FIG. 7B shows a top view of the display pallet 10 of FIG. 7A. FIG. 7C shows a side view of the pallet of FIG. 7A with a portion of the product removed, demonstrating the marketing use of backer panel 40.

Changes and modifications, additions and deletions may be made to the structures and methods recited above and shown in the drawings without departing from the scope or spirit of the invention.

What is claimed is:

1. An adjustable display for displaying products, comprising:

(a) at least two corner columns, each corner column comprising a central vertical fold that extends down each corner column and separates each corner column into two panels, each of the panels having a plurality of triangular insertion portions, (b) a plurality of V-shaped span members having first and second ends received in the one or more triangular insertion portions in use, wherein each first and second end of each span member rests directly on one of the triangular insertion portions, such that each V-shaped span member may be removed and replaced in a different triangular insertion portion as desired in order to provide a scalable and adjustable display pallet.

2. The adjustable display of claim 1, further comprising a lower horizontal fold line on each of the two panels of each corner column, wherein when folded, the fold lines of each corner column define two lower base panels that overlap one another in use to form a base.

3. The adjustable display of claim 1, further comprising a pallet base onto which the display pallet is attached in use.

4. The adjustable display of claim 1, wherein the corner columns are comprised of corrugated paperboard, plastic, aluminum, or wood.

5. The adjustable display of claim 1, wherein the span members are comprised of stacked laminate fiberboard, corrugated material, extruded aluminum, plastic, or wood.

6. The adjustable display of claim 1, wherein the span members are comprised of corner posts initially designed to support sides and bottom areas of products shipped on pallets, but that are re-purposed for use as the span members in the adjustable display.

7. The adjustable display of claim 1, wherein the V-shaped span members comprise two sides that are connected at an angle to form an open-topped triangular shelf in use.

8. The adjustable display of claim 1, further comprising one or more end caps that cover the ends of the one or more V-shaped span members.

9. The adjustable display of claim 8, wherein the one or more end caps are disposed at a span member/corner column junction.

10. The adjustable display of claim 1, further comprising panel backers secured to and extending between the two corner columns.

11. The adjustable display of claim 1, wherein the display pallet is a multi-sided unit.

12. The adjustable display of claim 11, wherein the multi-sided unit comprises more than two corner columns, with each corner column comprising first and second corner column panels having one or more triangular insertion portions, wherein a first set of triangular insertion portions on one first panel receives one or more V-shaped span members to cooperate with a first panel on another column, and wherein a second set of triangular insertion portions on a second panel receives one or more V-shaped span members to cooperate with a second panel on another column.

13. The adjustable display of claim 1, further comprising a pallet base and a pallet locator pad onto which the display pallet is adapted to be attached.

14. A method of manufacturing an adjustable display pallet for displaying products, comprising:

(a) providing a pallet base;

(b) providing two or more corner columns, each corner column comprising a foldable member with a central vertical fold that extends down each corner column and separates each corner column into two panels, each of the panels having one or more triangular insertion portions, (c) providing one or more v-shaped span members;

(d) assembling the corner column by folding the panels at an angle to one another;

(e) securing the panels to the pallet base; and (f) placing one or more V-shaped span members into the triangular insertion portions of the corner column panels wherein the one or more V-shaped span members rest on and protrude through the one or more triangular insertion portions, such that the one or more V-shaped span members may be removed and replaced in different triangular insertion portions as desired in order to provide a scalable and adjustable display pallet.

15. The method of claim 14, further comprising:

(g) providing one or more end caps; and (h) applying the one or more end caps at a span member/corner column junction to cover an end of a span member.

16. The method of claim 15, wherein the end caps are printed with marketing material.

17. The method of claim 14, further comprising:

(g) providing backer panels; and (h) applying the backer panels to one or more corner columns to provide a visual back to the display and to hide framing of the display unit as the product sells down.

18. The method of claim 17, wherein the backer panels are printed with marketing material.

19. The method of claim 14, further comprising:

(g) loading a product to be displayed on the span members.

20. The method of claim 14, wherein each panel of each corner column further comprises a lower horizontal fold line that, when folded, defines a lower base panel, wherein two lower base panels overlap over one another in use to form a base.

21. The method of claim 14, wherein the corner columns are provided as flat blanks.

22. The method of claim 14, further comprising a pallet locator pad disposed between the pallet base and the two or more corner columns.

23. The method of claim 14, further comprising a lower horizontal fold line on each of the two panels of each corner column, wherein when folded, the fold lines of each corner column define two lower base panels that overlap one another in use to form a base.

24. An adjustable display for displaying products, comprising:

(a) at least two corner columns, each corner column comprising a foldable member with a central vertical fold that extends down each corner column and separates each corner column into first and second panels, the first and second panels each having a plurality of triangular insertion portions, (b) a plurality of V-shaped span members having first and second ends;

wherein each triangular insertion portion on the first panel receives the first end of one of the span members, and wherein a second triangular insertion portion on the second panel receives the second end of the same span member, wherein the V-shaped span members rest on and protrude through the triangular insertion portions such that the one or more V-shaped span members may be removed and replaced in different triangular insertion portions as desired in order to provide a scalable and adjustable display.

* * * * *

UNITED STATES PATENT AND TRADEMARK OFFICE

CERTIFICATE OF CORRECTION

Figure 8:
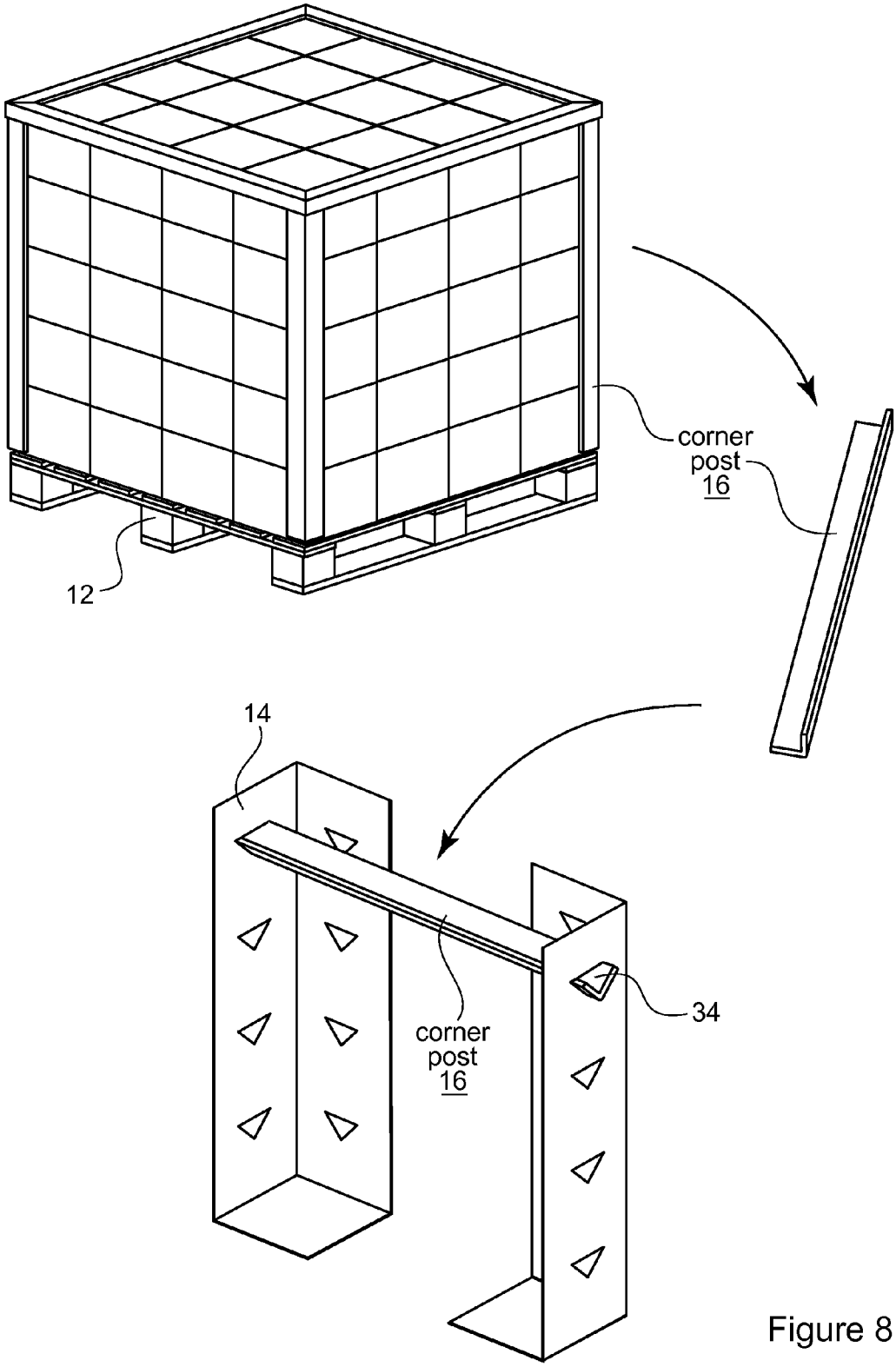
FIG. 8 shows a perspective view of how a span member may be formed by a corner post that is used to support materials during shipping on a pallet.
Figure 1:
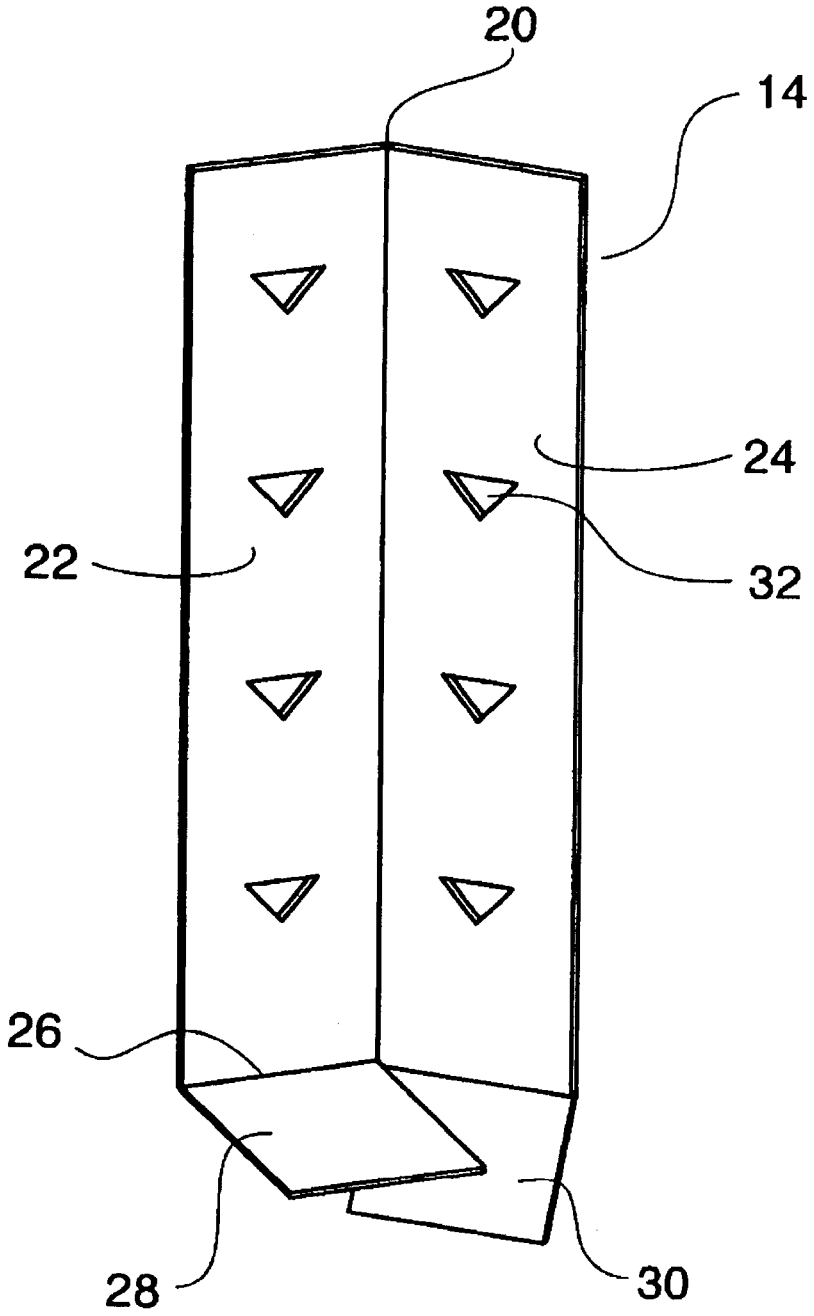
Figure 2:
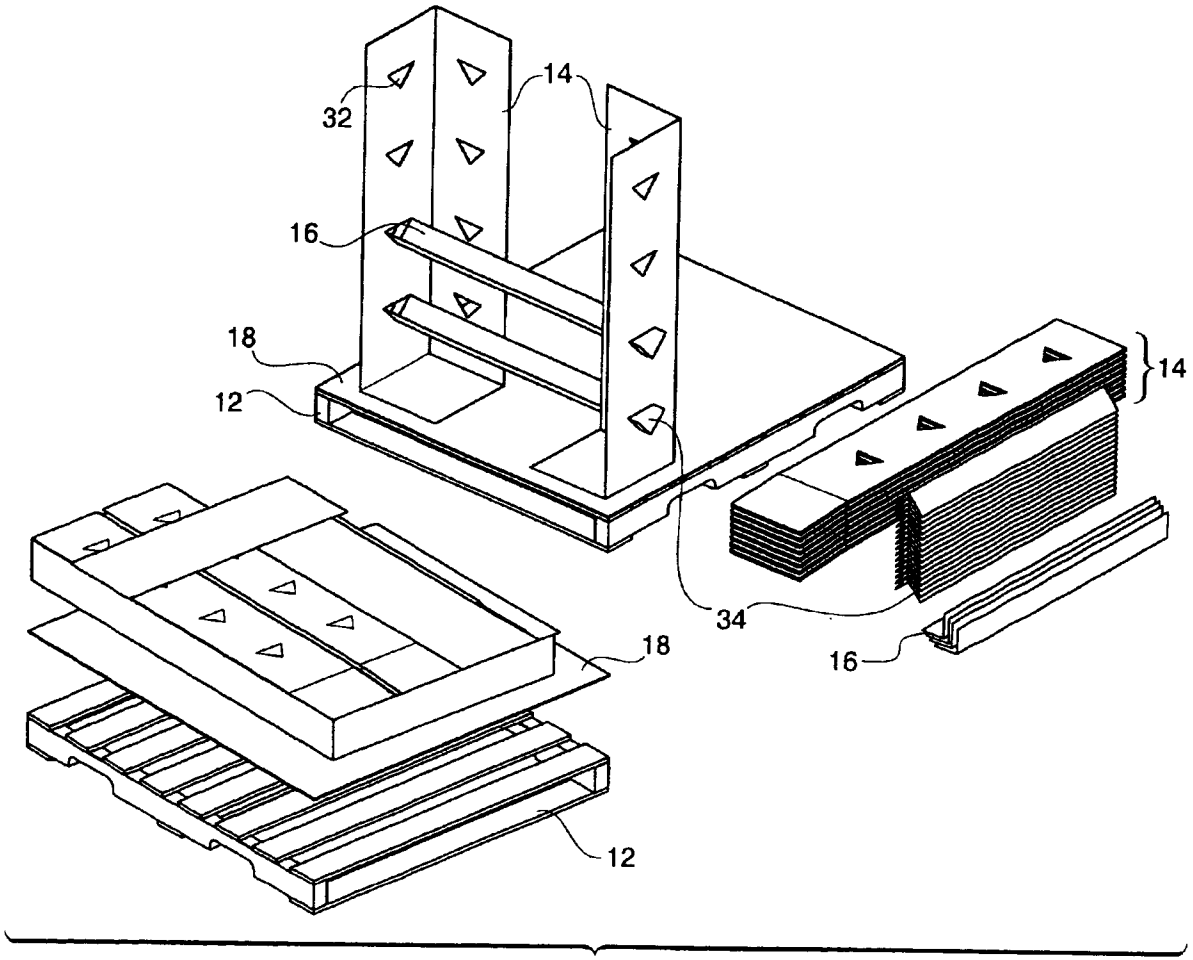
Figure 3:
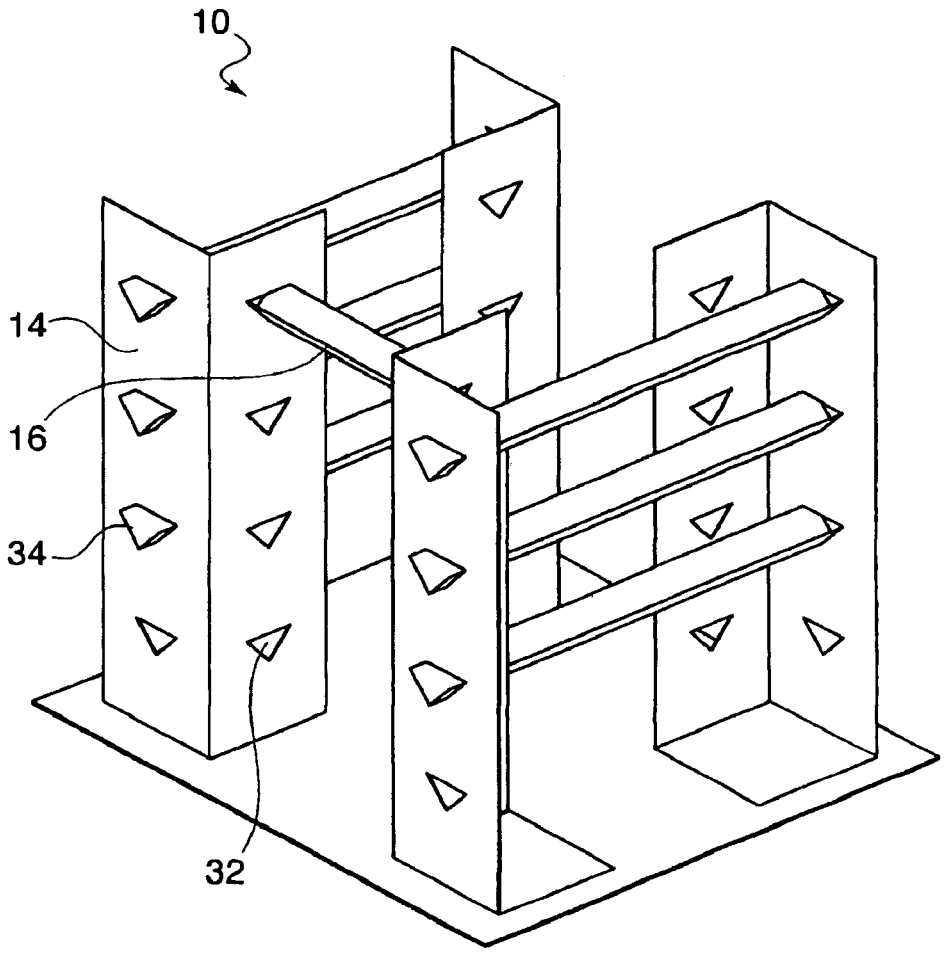
Figure 4:
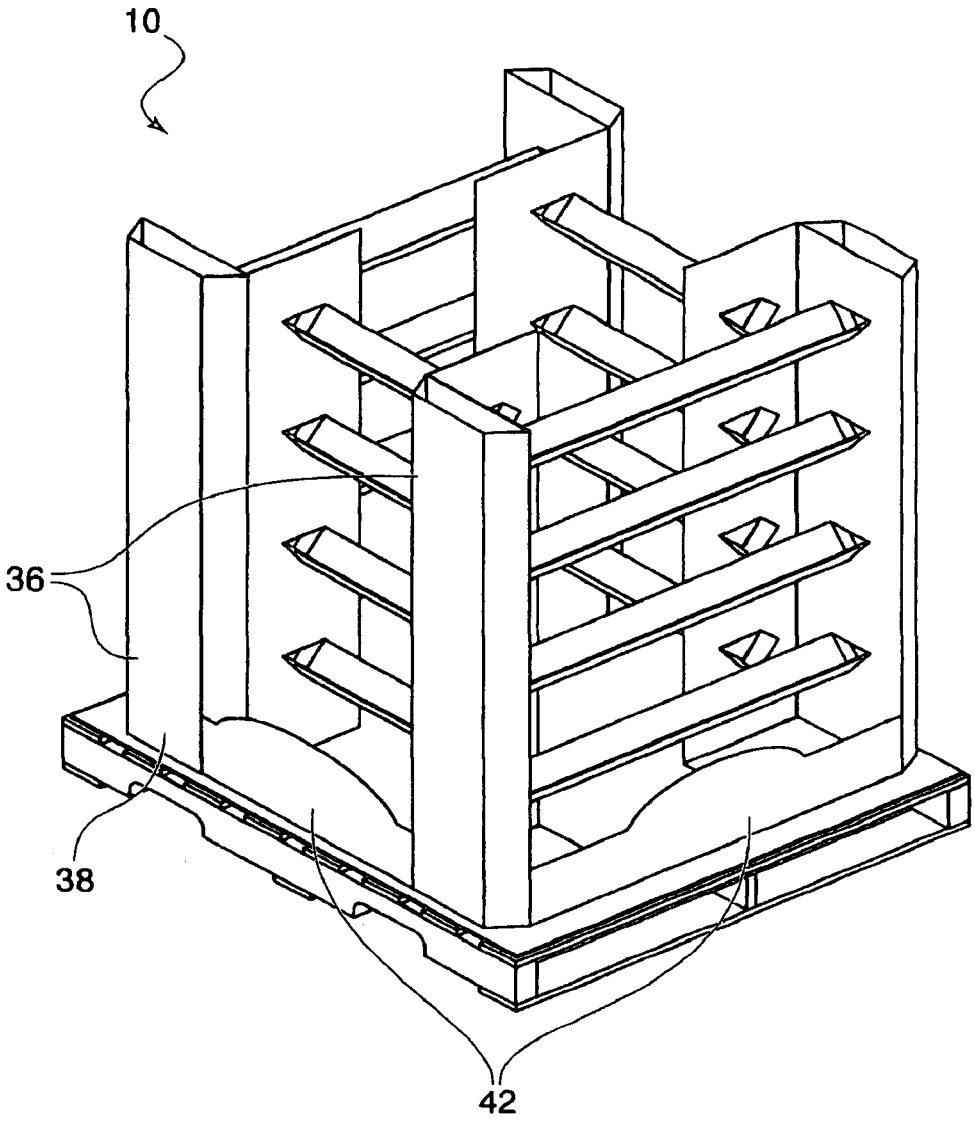
Figure 5:
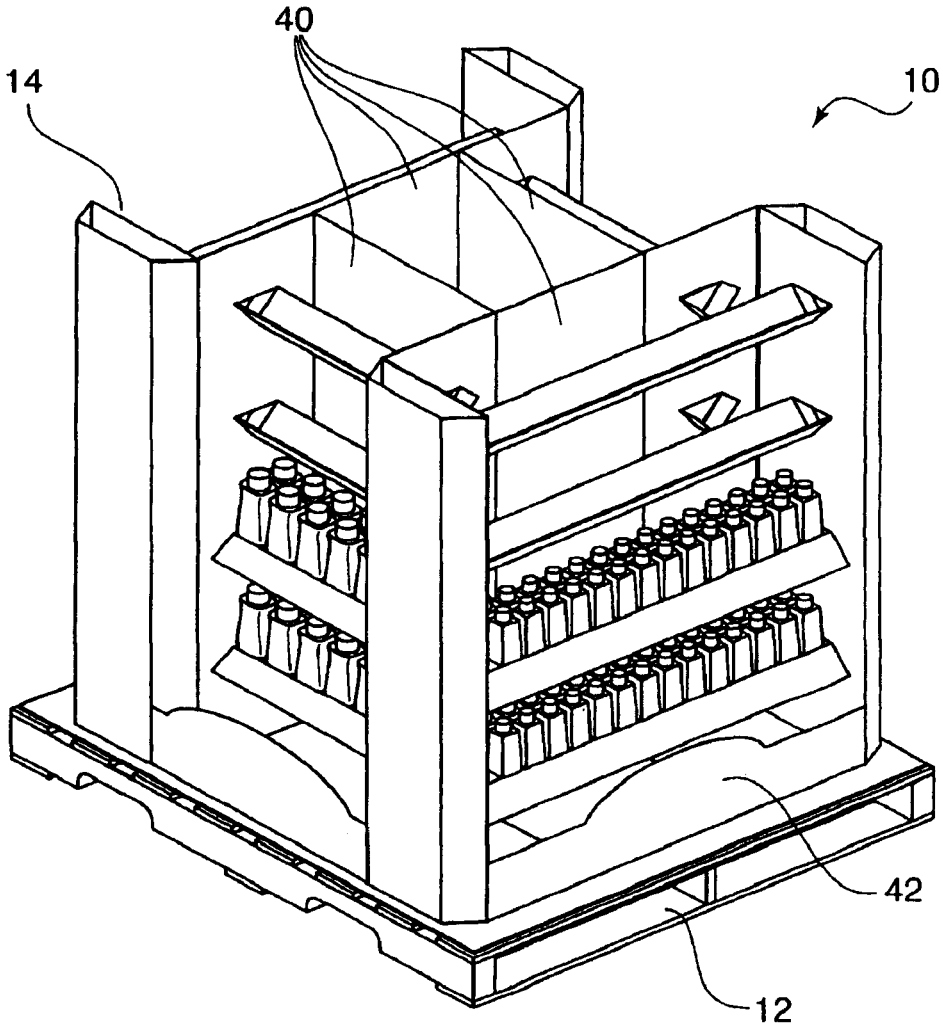
Figure 6:
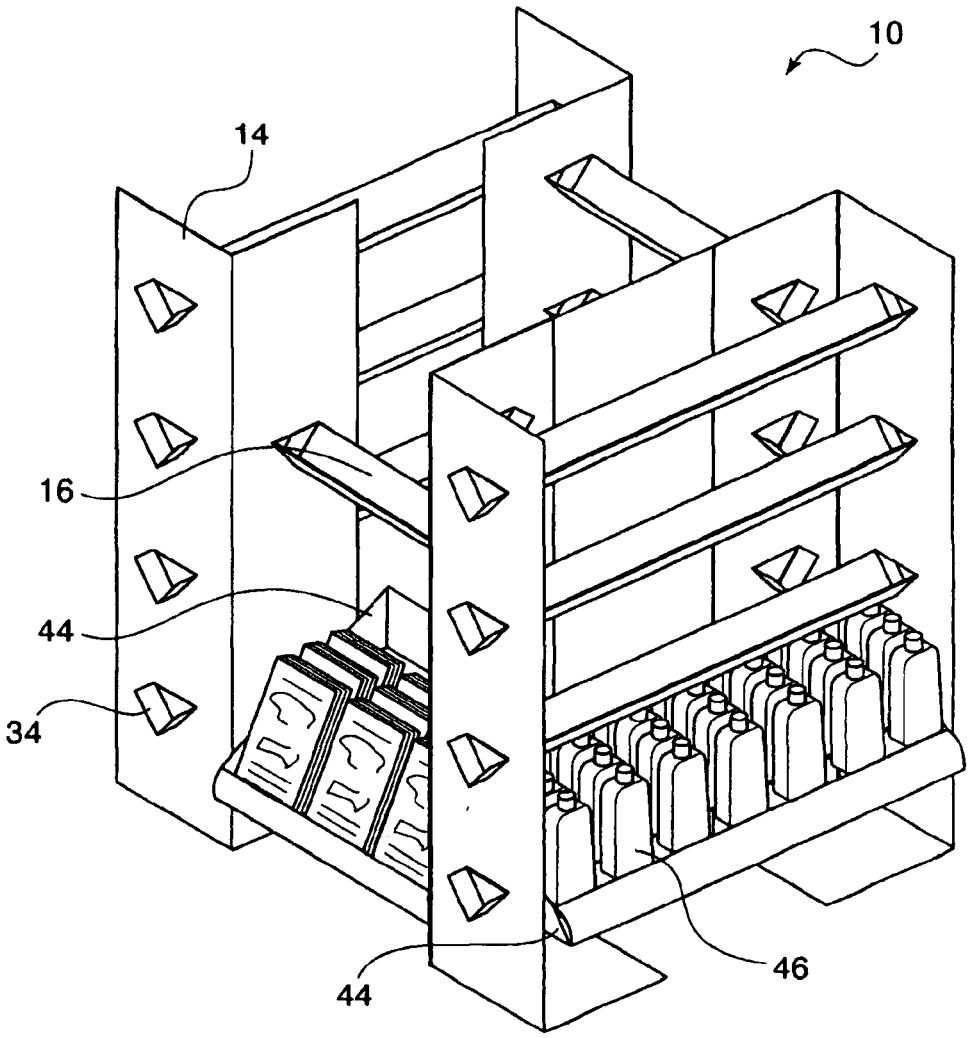
Figure 7A:
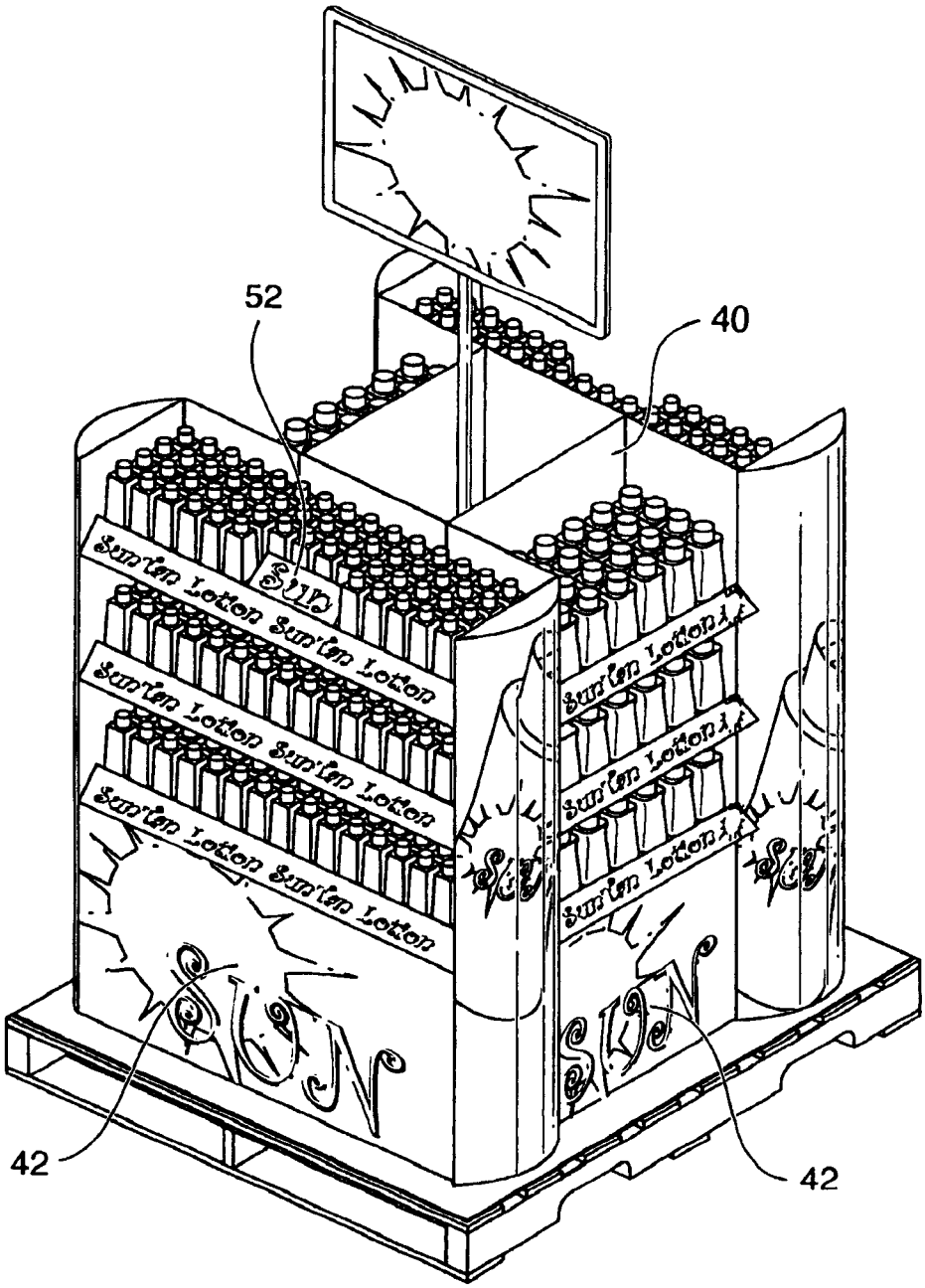
Figure 7C:
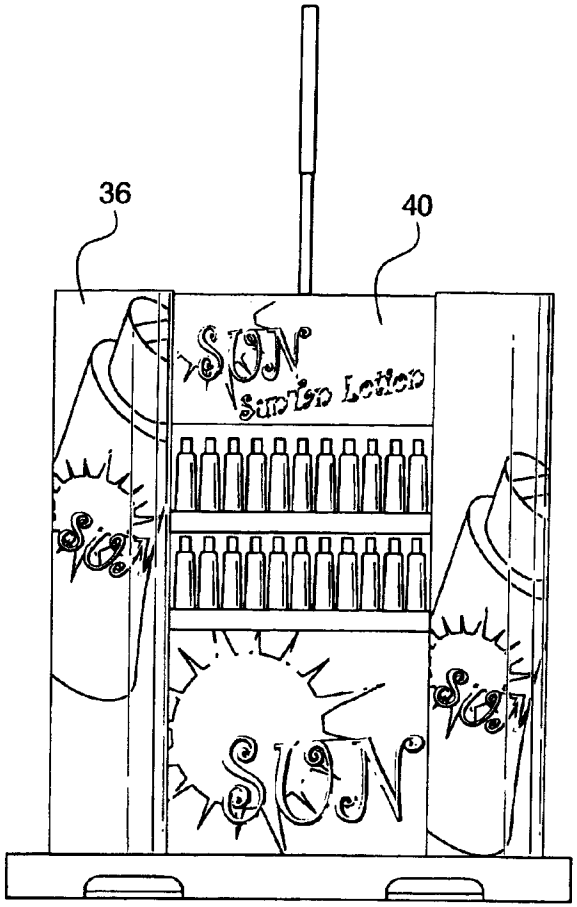
Figure 7B:
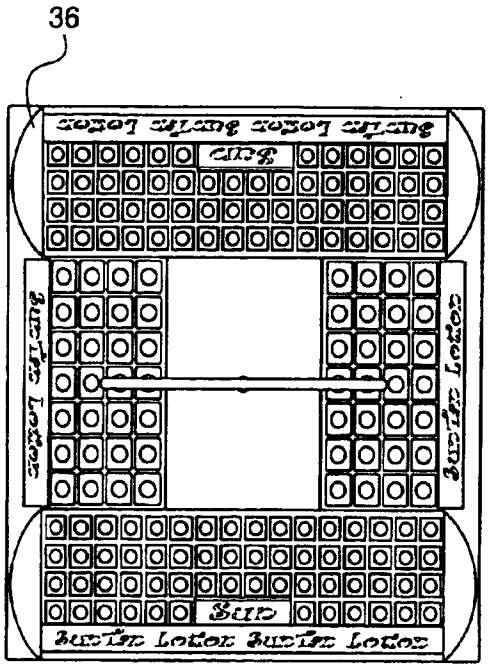

PATENT NO. : 8,091,715 B2
APPLICATION NO. : 11/414075
DATED : January 10, 2012
INVENTOR(S) : Michael C. Roth It is certified that error appears in the above-identified patent and that said Letters Patent is hereby corrected as shown below:

Figure 8
Delete Figure 8

Column 2, Lines 60-62
Delete Lines 60-62

Signed and Sealed this
Fifteenth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,091,715 B2
APPLICATION NO. : 11/414075
DATED : January 10, 2012
INVENTOR(S) : Michael C. Roth It is certified that error appears in the above-identified patent and that said Letters Patent is hereby corrected as shown below:

Delete the title page and substitute therefore the attached title page showing the corrected number of drawing sheets in patent.

Delete Drawing Sheets 1-9 and substitute therefore the attached Drawing Sheets 1-8. FIG. 8 has been cancelled.

Column 2, delete lines 60-62.

This certificate supersedes the Certificate of Correction issued May 15, 2012.

Signed and Sealed this
Twelfth Day of June, 2012

David J. Kappos

David J. Kappos
*Director of the United States Patent and Trademark Office*

(12) United States Patent
Roth

(10) Patent No.: US 8,091,715 B2
(45) Date of Patent: Jan. 10, 2012

(54) ADJUSTABLE PALLET DISPLAY UNIT

(75) Inventor: Michael C. Roth, Highland, NJ (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 895 days.

(21) Appl. No.: 11/414,075

(22) Filed: Apr. 28, 2006

(65) Prior Publication Data

US 2007/0000857 A1 Jan. 4, 2007

Related U.S. Application Data

(60) Provisional application No. 60/676,078, filed on Apr. 28, 2005.

(51) Int. Cl.
*A47B 47/06* (2006.01)
*A47B 57/34* (2006.01)

(52) U.S. Cl. ..... 211/187; 211/191

(58) Field of Classification Search ..... 211/195, 211/186, 149, 72, 73, 134, 70.1, 191, 187; 108/115, 53.5
See application file for complete search history.

(56) References Cited

U.S. PATENT DOCUMENTS

| | | | | | |
|---|---|---|---|---|---|
| 1,519,207 | A * | 12/1924 | Kay | 108/101 |
| 2,049,231 | A * | 7/1936 | Storch | 108/165 |
| 3,322,382 | A * | 5/1967 | Rohrbach | 248/159 |
| 4,488,652 | A * | 12/1984 | Hinton et al. | 211/183 |
| 4,813,553 | A * | 3/1989 | Franklin et al. | 211/133.1 |
| 4,879,800 | A * | 11/1989 | Rumman | 29/450 |
| 4,996,929 | A * | 3/1991 | Saal | 108/107 |
| 5,048,701 | A * | 9/1991 | Simpson | 211/189 |
| 5,632,390 | A * | 5/1997 | Podergois | 211/195 |
| 5,785,183 | A * | 7/1998 | Rejete | 211/1.51 |
| 5,896,995 | A * | 4/1999 | Murray et al. | 206/736 |
| 6,135,033 | A * | 10/2000 | Deferrari | 108/165 |
| 6,267,255 | B1 * | 7/2001 | Brush | 211/59.4 |
| 6,382,433 | B1 * | 5/2002 | Podergois | 211/195 |
| 6,474,483 | B1 * | 11/2002 | Montoya et al. | 211/149 |
| D489,198 | S * | 5/2004 | Mason et al. | D6/461 |
| 6,920,831 | B2 * | 7/2005 | Lin | 108/107 |
| 7,140,307 | B1 * | 11/2006 | Wolbert | 108/153.1 |
| 7,252,200 | B1 * | 8/2007 | Hester | 211/72 |
| 7,258,231 | B1 * | 8/2007 | Wertz et al. | 206/386 |
| 2001/0002652 | A1 * | 6/2001 | Polacco | 206/386 |

* cited by examiner

*Primary Examiner* — Michael Safavi
(74) *Attorney, Agent, or Firm* — Kilpatrick Townsend & Stockton LLP

(57) ABSTRACT

There is provided an adjustable display pallet and a method for manufacturing display pallets. In certain embodiments, display pallets have a pallet base, corner columns, and span members that are adapted to hold individual products or trays of product. Corner columns are adhered to the pallet base in the desired locations. Span members are then inserted through insertion portions on the corner columns. The insertion portions are shaped to receive and secure span member ends. Optional end caps, backer panels and print panels may be provided on the pallet displays to enhance visual aspects of the display, as well as provide additional marketing space.

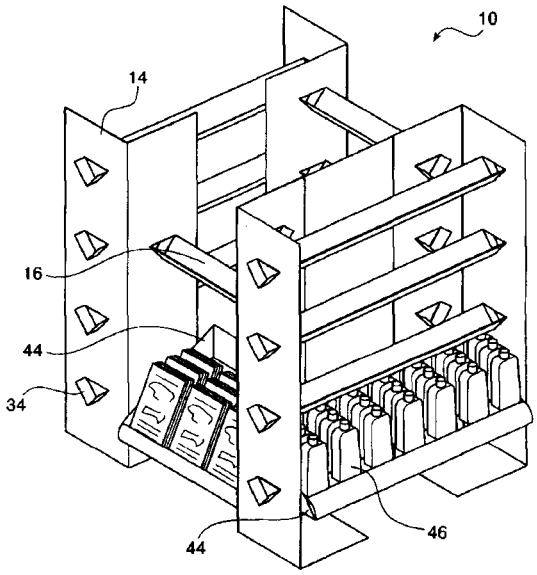

24 Claims, 8 Drawing Sheets